US009410331B2

(12) United States Patent
King et al.

(10) Patent No.: US 9,410,331 B2
(45) Date of Patent: Aug. 9, 2016

(54) MAGNETIC ANCHOR SYSTEM FOR SUSPENSION WORK EQUIPMENT, METHOD OF REMOTELY ATTACHING A SUSPENDED WORK PLATFORM TO A WORK STRUCTURE, AND A SYSTEM AND DEVICE FOR SAME

(71) Applicant: SKY CLIMBER ACCESS SOLUTIONS ATLANTA LLC, Delaware, OH (US)

(72) Inventors: Todd King, Dublin, OH (US); George M. Anasis, New Albany, OH (US)

(73) Assignee: SKY CLIMBER ACCESS SOLUTIONS ATLANTA LLC, Delaware, OH (US)

( * ) Notice: Subject to any disclaimer, the term of this patent is extended or adjusted under 35 U.S.C. 154(b) by 64 days.

(21) Appl. No.: 14/305,375

(22) Filed: Jun. 16, 2014

(65) Prior Publication Data

US 2015/0014095 A1 Jan. 15, 2015

Related U.S. Application Data

(60) Provisional application No. 61/835,981, filed on Jun. 17, 2013.

(51) Int. Cl.

| | |
|---|---|
| ***E04G 3/30*** | (2006.01) |
| ***E04G 3/32*** | (2006.01) |
| ***E04G 5/04*** | (2006.01) |
| ***B66D 1/60*** | (2006.01) |

(52) U.S. Cl.

CPC ..... *E04G 3/325* (2013.01); *B66D 1/605* (2013.01); *E04G 3/305* (2013.01); *E04G 5/04* (2013.01)

(58) Field of Classification Search

CPC ..... E04G 3/305; E04G 5/007; B66D 1/605

See application file for complete search history.

(56) References Cited

U.S. PATENT DOCUMENTS

| | | | |
|---|---|---|---|
| 1,200,404 | A | 10/1916 | White |
| 2,545,356 | A | 3/1951 | Hodgson |
| 2,954,257 | A | 5/1958 | Besuch et al. |
| 3,009,727 | A | 11/1961 | Jones et al. |
| 3,837,428 | A | 9/1974 | Gish |
| 4,960,185 | A | 10/1990 | Thiem |
| 7,934,585 | B2 | 5/2011 | Iversen |
| 8,149,078 | B2 | 4/2012 | Chiang |
| 8,292,242 | B2 | 10/2012 | Thompson |
| 8,390,271 | B2 | 3/2013 | Cardone |
| 2011/0198174 | A1 | 8/2011 | Ollgaard |

(Continued)

FOREIGN PATENT DOCUMENTS

| | | | |
|---|---|---|---|
| FR | 2517106 | 5/1983 | |
| JP | WO 2011161740 A1 * | 12/2011 | ..... B66D 1/605 |

*Primary Examiner* — Charles A Fox
*Assistant Examiner* — Kristine Florio
(74) *Attorney, Agent, or Firm* — David J. Dawsey; Michael J. Gallagher; Gallagher & Dawsey Co., LPA

(57) ABSTRACT

A magnetic anchor system, method, and device for attaching a rigging line to an elevated work structure. A transport vehicle may be used to position and attach at least one magnetic anchor to the elevated work structure, while being operated by a user at a safe location. Upon attachment of the magnetic anchor the strength of the magnetic connection of the primary magnetic anchor to the work structure is tested before anything is attached to a rigging line secured to the magnetic anchor.

13 Claims, 9 Drawing Sheets

(56) References Cited

U.S. PATENT DOCUMENTS

2012/0305728 A1 12/2012 Gravendeel et al.
2013/0043363 A1 2/2013 Thompson
2014/0054110 A1* 2/2014 Fernandez Gomez .... E04G 3/30 182/19
2015/0075910 A1* 3/2015 Thacker ..... E04G 5/04 182/229

* cited by examiner

MAGNETIC ANCHOR SYSTEM FOR SUSPENSION WORK EQUIPMENT, METHOD OF REMOTELY ATTACHING A SUSPENDED WORK PLATFORM TO A WORK STRUCTURE, AND A SYSTEM AND DEVICE FOR SAME

CROSS-REFERENCE TO RELATED APPLICATIONS

This application claims the benefit of U.S. provisional patent application Ser. No. 61/835,981, filed on Jun. 17, 2013, all of which are incorporated by reference as if completely written herein.

STATEMENT REGARDING FEDERALLY SPONSORED RESEARCH OR DEVELOPMENT

Not applicable.

TECHNICAL FIELD

The present disclosure relates to methods of attaching suspension work equipment to elevated structures.

BACKGROUND OF THE INVENTION

Currently maintenance personnel working on an elevated work structure such as, but not limited to, wind turbine towers, water towers, storage tanks, stacks, flues, marine vessels, and bridges, are required to climb the structure, or be lifted onto the structure by a helicopter, crane, or the like, and physically connect rigging lines to pre-existing anchor points, or attach the anchor points themselves. Now, with advancements made in magnet and robotic technology, a transport vehicle can transport and affix a primary magnetic anchor to a desired primary anchor position on the work structure. As such, the need for climbing the structure and physically affixing the rigging line, or the use of a crane, helicopter, or scaffolding system is eliminated.

SUMMARY OF THE INVENTION

A magnetic anchoring system for suspension equipment and a method of remotely attaching suspended work equipment to a work structure enable a significant advance in the state of the art and greatly improve job site safety. The method of using a magnetic rigging line anchoring system in order to remotely attach a rigging line to a work structure includes the step of positioning a primary magnetic anchor in a transport vehicle and attaching the transport vehicle to the work structure. In some instances, the transport vehicle is light enough in weight that maintenance personnel can simply lift and place the transport vehicle on the side of the work structure. In some applications, however, the transport vehicle weighs too much to be lifted by maintenance personnel and must be lifted and positioned on the work structure by a fork lift, or other equipment designed to lift the load. After the transport vehicle is attached to the side of the work structure, the transport vehicle transports the primary magnetic anchor vertically to a primary anchor position on the work structure at a primary anchor position elevation. After the transport vehicle reaches the primary anchor position, the primary magnetic anchor is attached to the work structure at the primary anchor position. Next, after the primary magnetic anchor is attached to the work structure, the strength of the connection of the primary magnetic anchor to the work structure is tested to ensure that no slippage or primary magnetic anchor disengagement will occur. A load testing system comprising of a standardized load may be used to ensure a satisfactory attachment of the primary magnetic anchor to the work structure. Alternatively, in other embodiments, the load testing system may utilize singularly or in combination: a winch system, a hydraulic cylinder, a pneumatic cylinder, or a magnetic load structure to deliver a predetermined load to ensure a satisfactory attachment of the primary magnetic anchor to the work structure. After verifying the connection quality of the primary magnetic anchor to the work structure, maintenance personnel may attach and suspend the work platform and a hoist on a rigging line secured to the primary magnetic anchor.

BRIEF DESCRIPTION OF THE DRAWINGS

Without limiting the scope of the method as claimed below and referring now to the drawings and figures:

Figure 1:
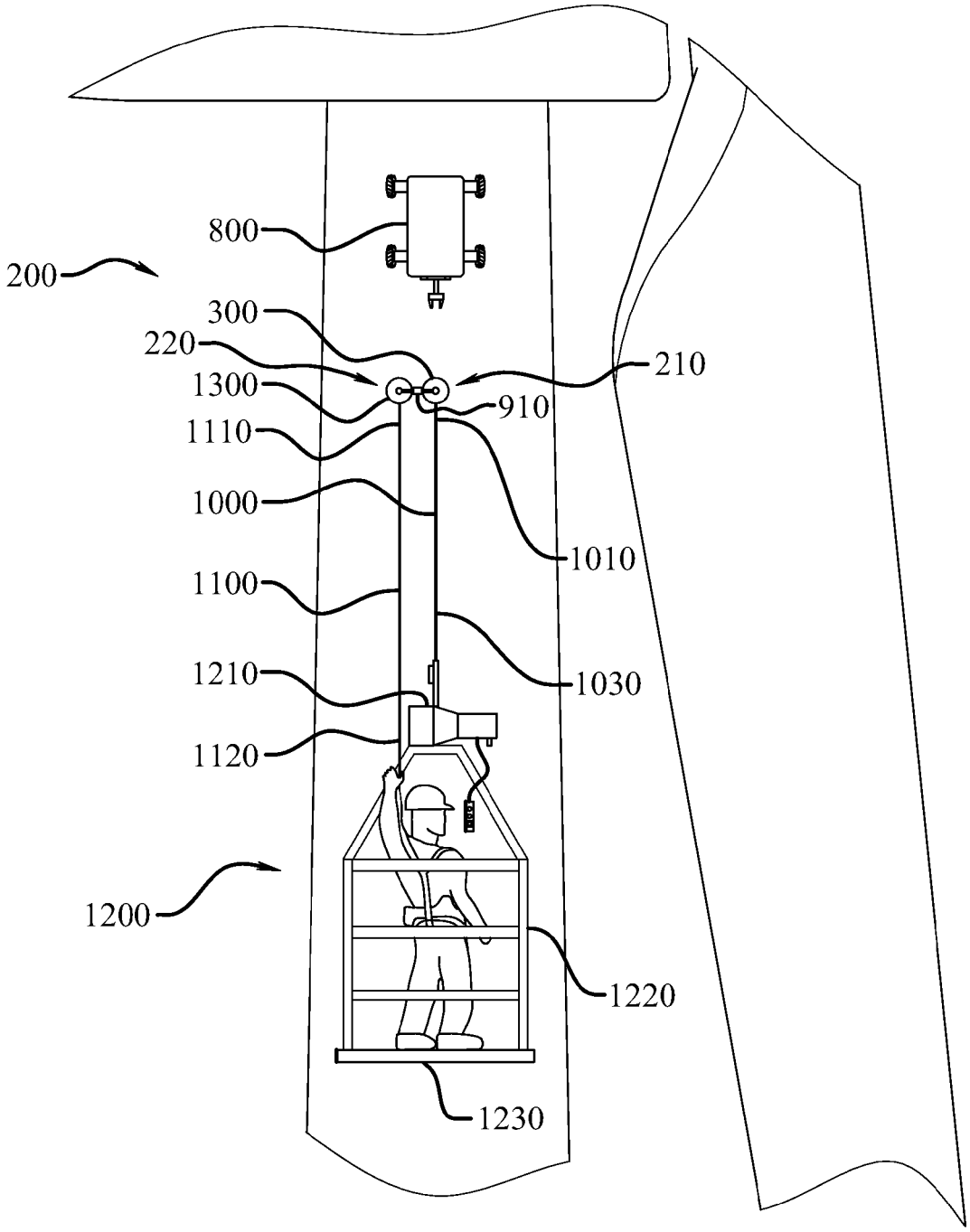
FIG. 1 is a partial side elevation view of a wind turbine tower and elements of the invention, not to scale.

These drawings are provided to assist in the understanding of the exemplary embodiments of the various apparatus associated with the method as described in more detail below and should not be construed as unduly limiting the claimed method. In particular, the relative spacing, positioning, sizing and dimensions of the various elements illustrated in the drawings are not drawn to scale and may have been exaggerated, reduced or otherwise modified for the purpose of improved clarity. Those of ordinary skill in the art will also appreciate that a range of alternative configurations have been omitted simply to improve the clarity and reduce the number of drawings.

DETAILED DESCRIPTION OF THE INVENTION

A magnetic anchoring system for suspension equipment and a method of remotely attaching a suspended work platform (1200) to a work structure (200) enable a significant advance in the state of the art. The preferred embodiments of the apparatus associated with the method accomplish this by new and novel arrangements of elements that are configured in unique and novel ways and which demonstrate previously unavailable but preferred and desirable capabilities. The detailed description set forth below in connection with the drawings is intended merely as a description of the presently preferred embodiments of the method, and is not intended to represent the only form in which the method may be performed or implemented. The description sets forth the designs, functions, means, and apparatus for implementing the method in connection with the illustrated embodiments. It is to be understood, however, that the same or equivalent functions and features may be accomplished by different embodiments that are also intended to be encompassed within the spirit and scope of the claimed method.

With reference now to FIG. 1, currently maintenance personnel working on a work structure (200) such as, but not limited to, wind turbine towers, water towers, storage tanks, stacks, flues, marine vessels, and bridges, are required to climb the structure and physically connect rigging lines (1000) to pre-existing anchor points, or attach the anchor points themselves. Now, with advancements made in magnet and robotic technology, a transport vehicle (800) can transport and affix a primary magnetic anchor (300) and/or a secondary magnetic anchor (1300) to a desired primary anchor position (210) or secondary anchor position (220) respectively on the work structure (200). As such, the need for climbing the structure and physically affixing the rigging line (1000), or the use of a crane or scaffolding system is eliminated. The method of using the magnetic rigging line anchoring system (100) will be described in more detail below.

Figure 2:
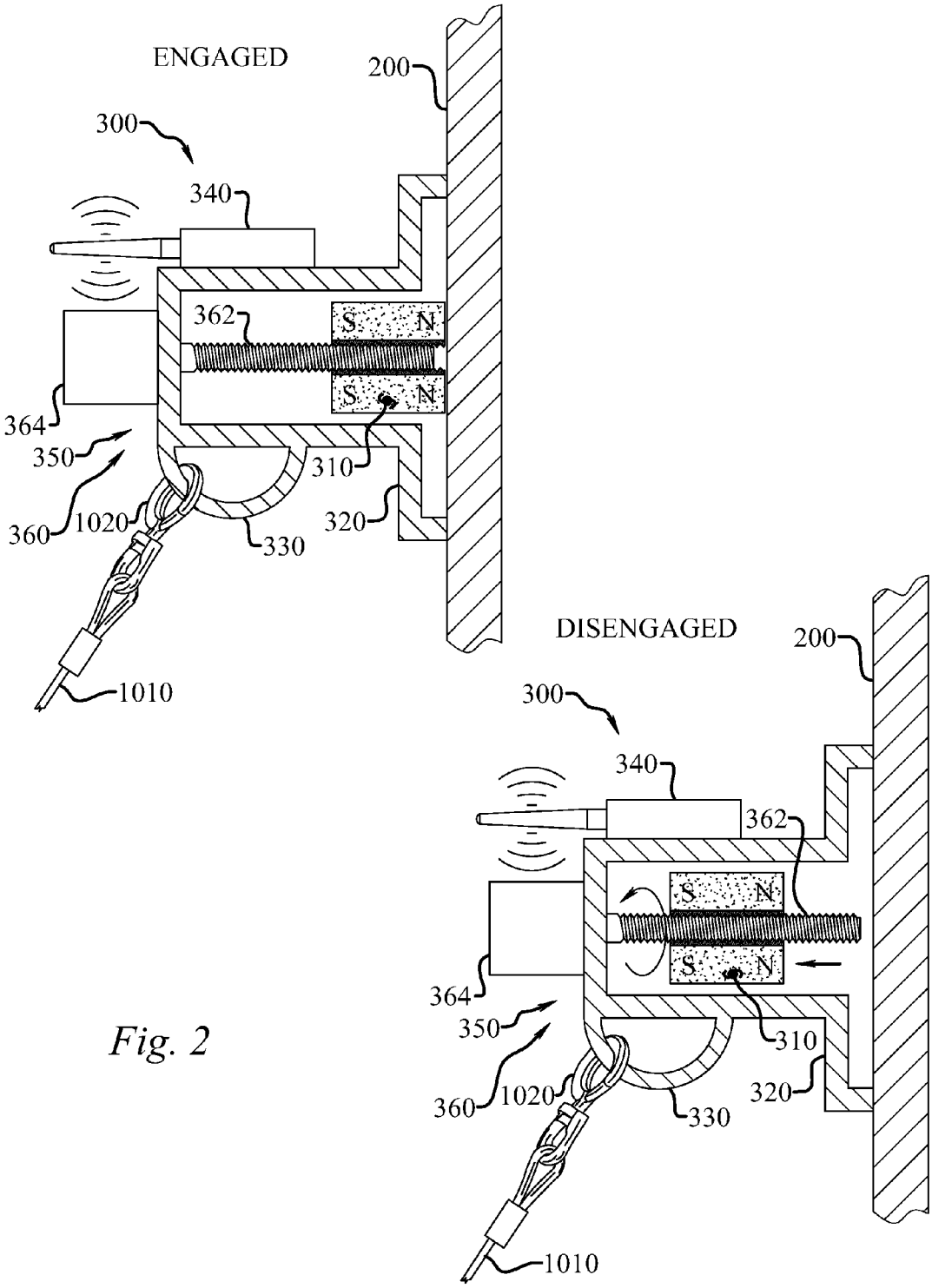
FIG. 2 is a partial cross-sectional view of an embodiment of the primary magnetic anchor, not to scale.
Figure 3:
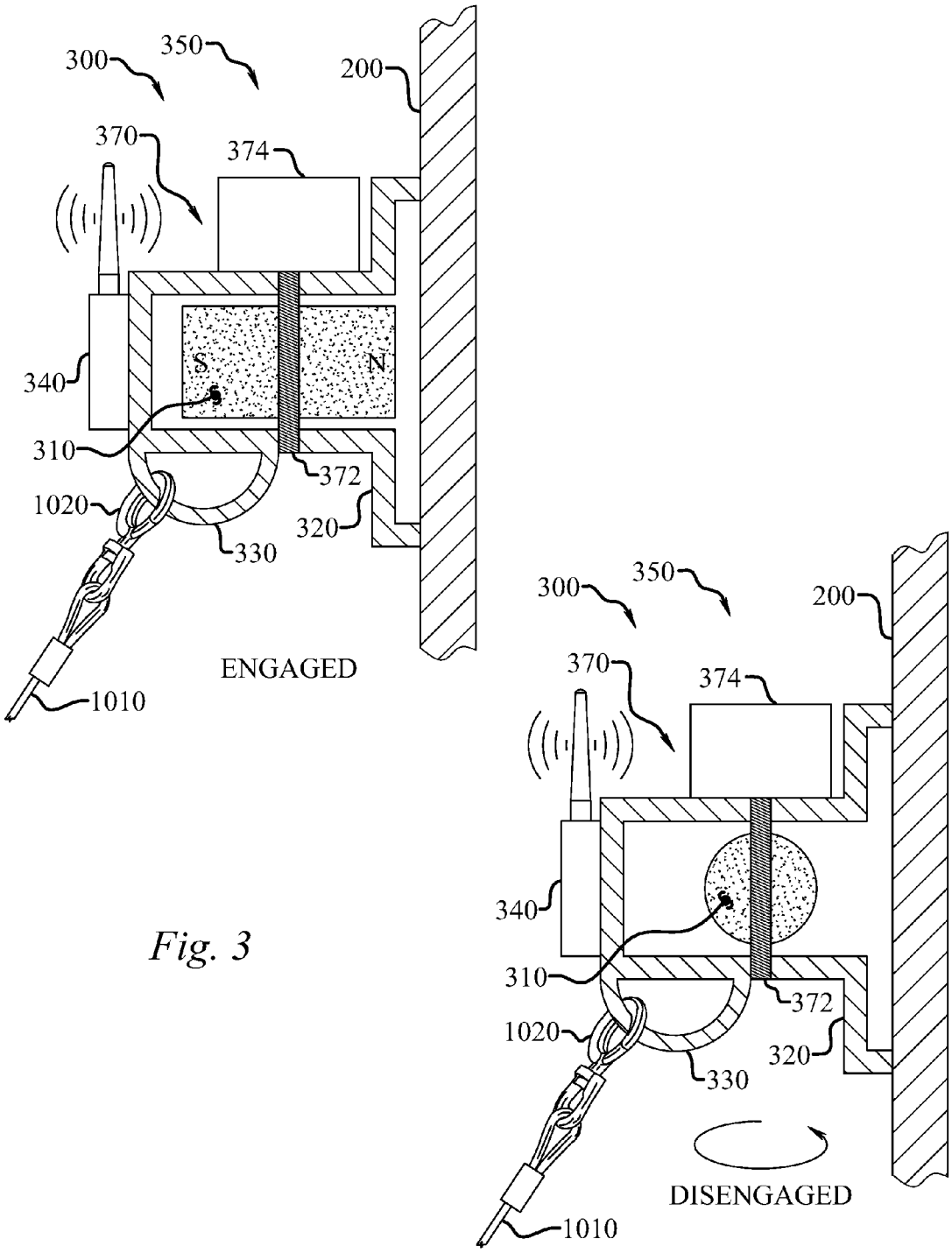
FIG. 3 is a partial cross-sectional view of an embodiment of the primary magnetic anchor, not to scale.
Figure 4:
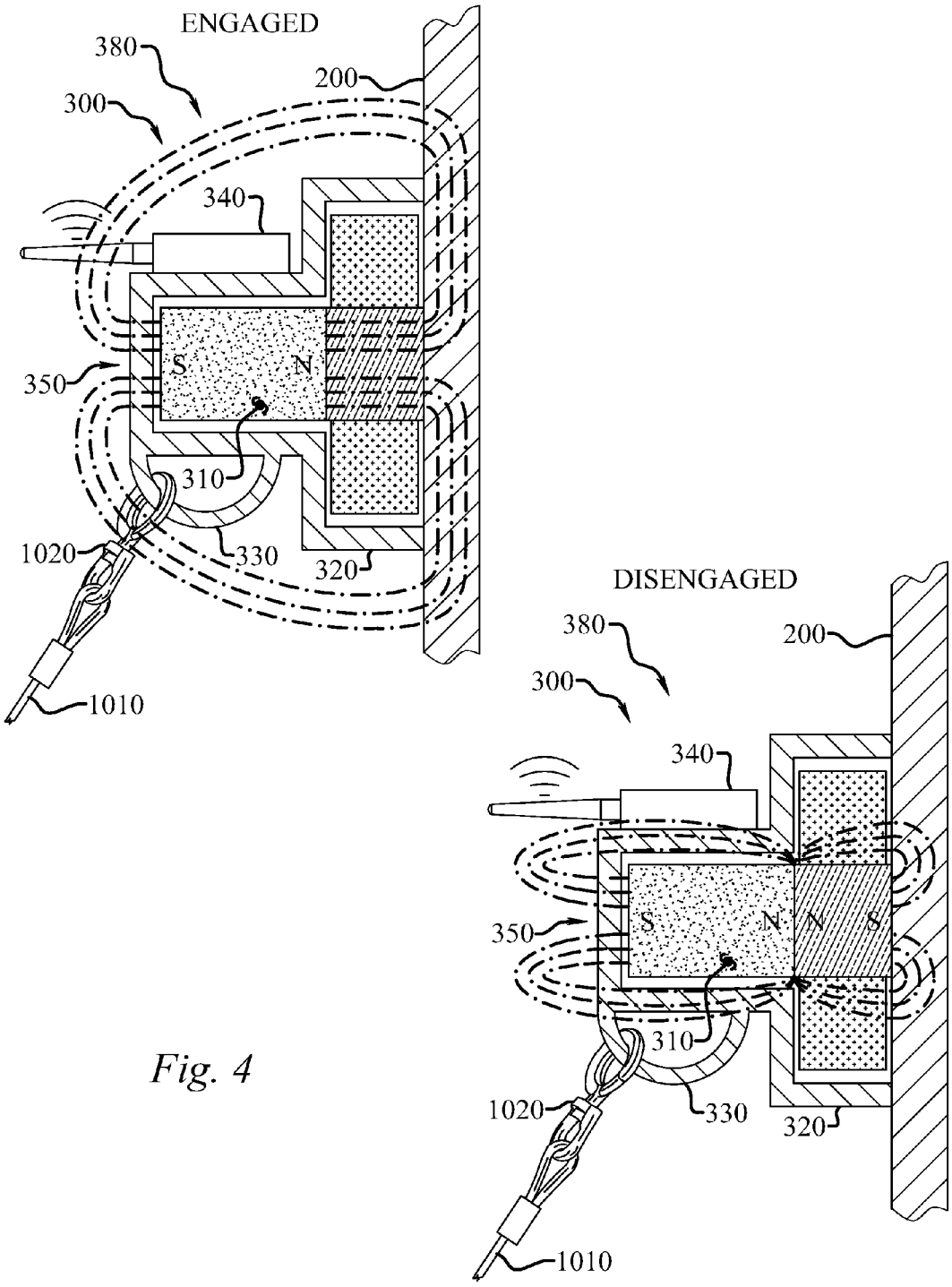
FIG. 4 is a partial cross-sectional view of an embodiment of the primary magnetic anchor, not to scale.

With reference now to FIGS. 2-4, a typical work structure (200) rigging line (1000) anchor attachment point consists of a permanently bolted or welded rigging attachment point, which is often elevated several hundred feet above the ground. However, the need for having a permanently bolted or welded rigging attachment point, as well as the need for a human to access the elevated rigging attachment point, can be eliminated by using a primary magnetic anchor (300) and/or secondary magnetic anchor (1300). The various embodiments of the primary and secondary magnetic anchors (300, 1300) share common components and modes of operation, which will be describe below. As such, when the various embodiments of the primary magnetic anchor (300) are described below, it can be inferred that an equivalent secondary magnetic anchor (1300) has all the same features, elements, and modes of operation of the embodiment being described at the time, even though not expressly repeated herein or illustrated separately.

The primary magnetic anchor (300) may be one of many embodiments. Some of the various embodiments share common features such as a body (320), one or more attachment magnets (310), a rigging attachment point (330), and/or an anchor release system (350). Furthermore, each of the various embodiments of the primary magnetic anchor (300) may include a primary anchor location system (340).

The primary magnetic anchor body (320), as seen in FIGS. 2-4, acts as both an enclosure and frame which houses some, if not all, of the other primary magnetic anchor (300). The body (320) may be composed of a multitude of materials, including, but not limited to, ferromagnetic materials; aluminum and other non-ferrous metals; fiber resin materials; cast plastic materials; or any combination thereof. One advantage of using ferromagnetic materials for the body (320) is that it can be used to help conduct the magnetic flux between the primary magnetic anchor (300) and the work structure (200), thereby increasing the primary magnetic anchor's (300) ability to clamp to the work structure (200). However, ferromagnetic materials have their draw backs when used in the construction of the body (320) in that they tend to become magnetic; and as a result, reduce the releasability of the primary magnetic anchor (300). Aluminum or other non-ferrous metals such as magnesium, fiber resin, and cast plastic materials are light weight thereby making their transportation by a transport vehicle (800) less demanding, particularly in situations such as wind turbine towers and water tanks whereby the primary magnetic anchor (300) may need to be transported vertically several hundred feet. Furthermore, they are transparent to magnetic flux, which makes the removal of the primary magnetic anchor (300) easier, but does not conduct the primary magnetic anchors (300) magnetic flux to aid in the clampability of the primary magnetic anchor (300) to the work structure (200). Another possible feature, disclosed but not illustrated, on the body (320) is a friction inducing surface that helps prevent the primary magnetic anchor (300) from sliding down the side of the work structure (200) caused by shear forces acting on the primary magnetic anchor (300). The friction inducing surface is located on the side of the body (320) that is in contact with the work structure (200). Additionally, the friction inducing surface may be composed of, but not limited to, a rubber coating; bonded silica grit; or a geometric pattern formed in the primary magnetic anchor (300) which is designed to "bite" into the side of the work structure (200) when the primary magnetic anchor (300) is engaged.

Each primary magnetic anchor (300) has at least one attachment magnet (310), seen in FIGS. 2-4, which provides the clamping forces used to affix the primary magnetic anchor (300) to the side of a work structure (200). The primary magnetic anchor (300) may use, but is not limited to, permanent rare earth neodymium magnets, also known as NdFeB magnets. Neodymium magnets are graded by a letter and numbering system indicating both material of composition and magnetic strength. Additionally, neodymium magnets with grade N52 are the strongest permanent magnets currently made, and are more than ten times stronger than the strongest ceramic magnets currently on the market. For instance, take a N52 neodymium magnet 4"×4"×2" thick weighing around 140 ounces, would have a surface flux of approximately 4,900 Gauss and have a pull force of an approximately 1,225 pounds. Furthermore, neodymium magnets, unlike other magnets resist demagnetization, or in other words, the weakening of the magnet strength. By using multiple neodymium magnets, the clamping force generated by a primary magnetic anchor (300) can be increased to suspend several tons of weight. By combining the previously mentioned friction inducing surface materials with various neodymium magnet configurations, different primary magnetic anchor (300) shear load capacities can be obtained. In one embodiment, a primary magnetic anchor (300) may have a shear load capacity of at least 1000 pounds. In another embodiment, a primary magnetic anchor (300) may have a shear load capacity of at least 2000 pounds. In yet another embodiment, a primary magnetic anchor (300) has a shear load capacity in excess of 5000 pounds.

Naturally, due to the strength of neodymium magnets, special methods must be used to transport the magnets, engage the magnets, and release the magnets. As such, some embodiments include anchor release systems (350) to remove the primary magnetic anchor (300) from the work structure (200), which will be discussed below. In addition to an attachment magnet (310), the primary magnetic anchor (300) may include a rigging attachment point (330). The rigging attachment point (330) allows a rigging line (1000) to be attached to a primary magnetic anchor (300) and may be in the form, but not limited to: a fixed d-ring, swiveled d-ring, or an aperture in the primary magnetic anchor (300) body (320). The rigging line (1000) will be discussed in more detail below.

Figure 5:
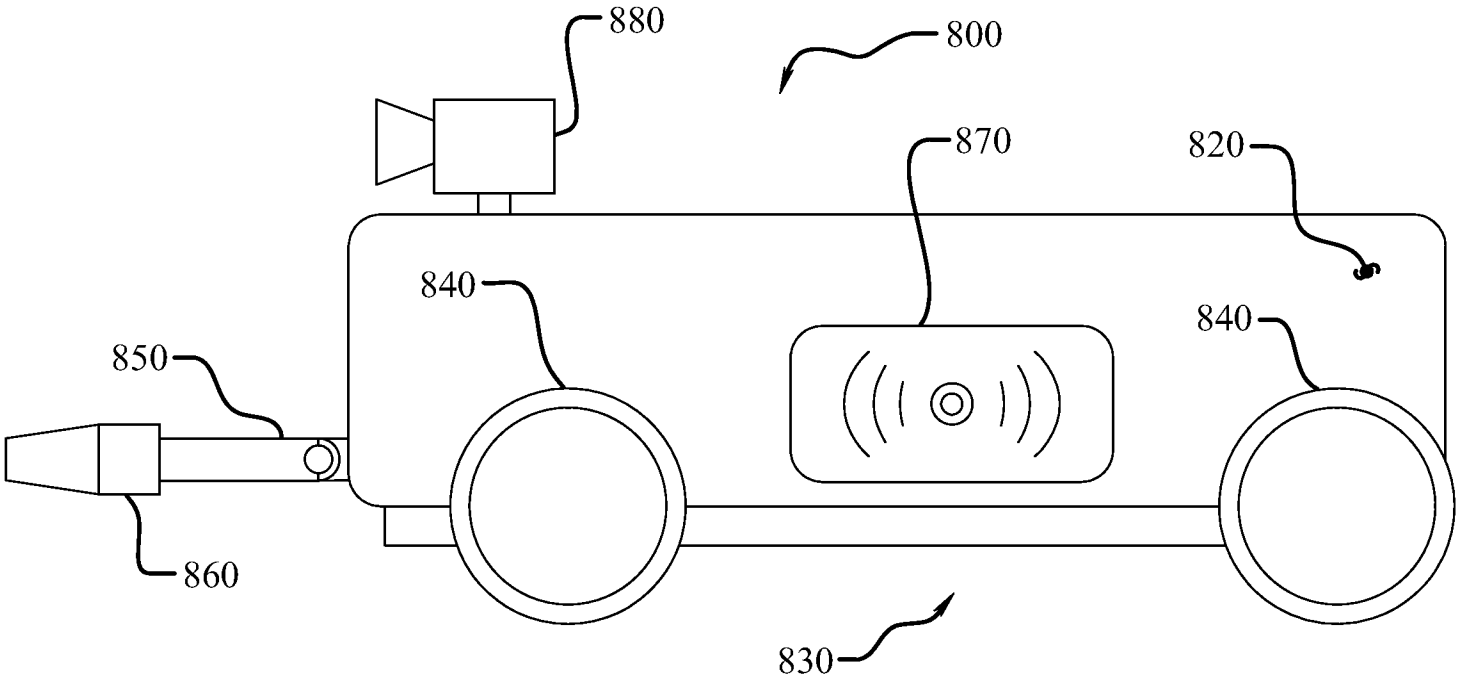
FIG. 5 is a side elevation view of an embodiment of the transport vehicle, not to scale.

Some embodiments of the primary magnetic anchor (300) and/or the transport vehicle (800) include a primary anchor location system (340), as seen in FIGS. 2-4. After the work structure (200) maintenance is complete, the primary magnetic anchor (300) must be retrieved by the transport vehicle (800) and returned to the maintenance personnel located at ground level. Unfortunately, some work structures (200) are very tall making it difficult to have visual clues in order to orient the transport vehicle (800) for docking and retrieval of the primary magnetic anchor (300). A video system (880), as illustrated in FIG. 5, located on the transport vehicle (800) provides a solution for finding the primary magnetic anchor (300) and orienting the transport vehicle (800) towards it. However, the last few inches during the docking procedure may be delicate. If the operator misjudges the approach of the transport vehicle (800) towards the primary magnetic anchor (300), they have a high likelihood of damaging the transport vehicle (800) and/or primary magnetic anchor (300). As such, the transport vehicle (800) may use a final approach docking procedure that is automated within the transport vehicle (800) control software. The primary anchor location system (340) gives the control software in charge of the final approach docking procedure feedback as to the transport vehicle (800) approaches the primary magnetic anchor (300), thereby providing a means for automated final approach docking. The primary anchor location system (340) may take on any number of embodiments and combinations including, but not limited to, radio frequency (RF) guidance systems; ultrasonic echolocation systems; visual camera pattern recognition systems; light emitting diode (LED) and phototransistor systems; and magnetic field sensing systems.

In an embodiment of the primary anchor location system (340) that utilizes the micro radar feedback system, the primary anchor location system (340) starts sending out continuous radio frequency (RF) pulses from a transmitter. Likewise, the transport vehicle (800) has multiple (RF) receivers oriented in different directions from each other so that transport vehicle's (800) control software in charge of the final approach docking procedure receives feedback in regards to its orientation with respect to the primary magnetic anchor (300). Furthermore, the control software in charge of the final approach docking procedure can determine the distance between the transport vehicle (800) and the primary magnetic anchor (300) by magnitude of the (RF) signal strength.

Now concerning the embodiment of primary anchor location system (340) which utilizes the ultrasonic echolocation system, the primary anchor location system (340) is mounted on the transport vehicle (800) rather than the primary magnetic anchor (300). The primary anchor location system's (340) ultrasonic echolocation sensor consists of a ultrasonic transmitter and receiver and a means to move the ultrasonic echolocation sensor back and forth, thereby scanning the area in front of the transport vehicle (800). If the primary anchor location system's (340) ultrasonic echolocation sensor is oriented towards the primary magnetic anchor (300), part of the ultrasonic sound being transmitted will be reflected off of the primary magnetic anchor (300) and picked up by the ultrasonic receiver. As such, the control software in charge of the final approach docking procedure can determine the orientation of the transport vehicle (800) in respect to the primary magnetic anchor (300), and the distance there between by the angle of the ultrasonic echolocation sensor and magnitude of the reflected ultrasonic sound received by ultrasonic receiver.

In regards to the embodiment of primary anchor location system (340) which uses visual camera pattern recognition systems, the primary anchor location system (340) is composed of imaging processing software, a video system (880) located on the transport vehicle (800), and a geometric pattern marked on the primary magnetic anchor (300). After the transport vehicle (800) is roughly lined up for the final approach docking procedure, the video system (880) picks up the image of the geometric pattern marked on the primary magnetic anchor (300). Based on the angle between the transport vehicle (800) in respect to the primary magnetic anchor (300) and the distance there between, the geometric pattern marked on the primary magnetic anchor (300) will has specific angles and sizes, thereby allowing the control software in charge of the final approach docking procedure to determine distance and orientation of the transport vehicle (800) in respect to the primary magnetic anchor (300).

Now concerning the embodiment of the primary anchor location system (340) which utilizes a light emitting diode (LED) and phototransistor system, this embodiment may utilize an infrared LED which is located on the primary magnetic anchor (300), and multiple phototransistors located on the transport vehicle (800). In operation, if the transport vehicle (800) is correctly orientated on the proper course while approaching the primary magnetic anchor (300) each phototransistor will receive the same amount of light being transmitted by the infrared LED. However, if the transport vehicle (800) goes off course while approaching the primary magnetic anchor (300), one phototransistor will receive more light than the other phototransistor, and thereby telling the control software in charge of the final approach docking procedure correct the path. A limit switch located on the transport vehicle (800) stops the transport vehicle (800) when it arrives and makes contact with the primary magnetic anchor (300).

The primary anchor location system (340) utilizing magnetic field sensing system uses an electronic compass and/or Hall effect sensors located on the transport vehicle (800) to sense the magnetic field of the attachment magnet (310) located in the primary magnetic anchor (300). By determining the strength and orientation of the magnetic field, the control software in charge of the final approach docking procedure can determine both orientation and distance of the transport vehicle (800) in respect to the primary magnetic anchor (300) and make proper course corrections during the final approach docking procedure.

As stated previously, due to the strength of rare earth neodymium magnets, special anchor release systems (350) may be incorporated to remove the primary magnetic anchor (300) from the work structure (200). The anchor release system (350) may take on any number of embodiments, including, but not limited to, an anchor release system (350) having a set-off distance adjuster (360); an anchor release system (350) having a rotational adjustor (370); an anchor release system (350) having an electromagnetic adjustor (380); and lastly an anchor release system (350) having a pneumatic or hydraulic adjustor, not illustrated but understood to one skilled in the art in light of the related disclosure.

The first embodiment of an anchor release system (350) to be addressed is the anchor release system (350) having a set-off distance adjuster (360), as seen in FIG. 2. In this embodiment, the primary magnetic anchor (300) may include the previously mentioned body (320); attachment magnet (310); rigging attachment point (330); anchor release system (350); and may include a primary anchor location system (340). Additionally, the anchor release system (350) having a set-off distance adjuster (360) may include a drive screw (362) and a drive screw actuator (364). In one embodiment, the drive screw actuator (364) has a servo motor and gear box that is geared down to create high torque on the output shaft. In another embodiment, the drive screw actuator (364) consists of a large motor capable of creating large amounts of torque for turning heavy loads. The drive screw (362) may be physically coupled to the drive screw actuator (364) which in turn rotates the drive screw (362) clockwise or counter clockwise direction. In this embodiment of primary magnetic anchor (300) having a set-off distance adjustor (360), the attachment magnet (310) has a threaded bore, as seen in FIG. 2, that engages the threads of the drive screw (362) in such a way that as the drive screw (362) rotates it causes the attachment magnet (310) to move linearly towards or away from the work structure (200). The drive screw (362) also has the benefit of increasing the mechanical advantage of the process of removing the attachment magnet (310) from the surface of the work structure (200). The primary magnetic anchor (300) is in an engaged state when the attachment magnet (310) is within close proximity to the work structure (200), and in a disengaged state when the drive screw (362) pulls the attachment magnet (310) away from the work structure (200).

The next embodiment of an anchor release system (350) to be addressed is the anchor release system (350) having a rotational adjustor (370), as seen in FIG. 3. In this embodiment, the primary magnetic anchor (300) may include the previously mentioned body (320); attachment magnet (310); rigging attachment point (330); anchor release system (350); and may include a primary anchor location system (340). Additionally, the anchor release system (350) having a rotational adjustor (370) may include a rotational shaft (372) and a rotational actuator (374). In one embodiment, the rotational actuator (374) has a servo motor and gear box that is geared down to create large amounts of torque for turning heavy loads. In another embodiment, the rotational actuator (374) consists of a large motor capable of creating large amounts of torque for turning heavy loads. One end of the rotational shaft (372) passes through a bore located perpendicularly between the poles of the attachment magnet (310) and is permanently fixed therein, as seen in FIG. 3. The other end of the rotational shaft (372) is physically coupled to the rotational actuator (374). The rotational actuator (374) can rotate the attachment magnet (310) into an engage position where one of the attachment magnet (310) poles are perpendicular and in close proximity to the side of the work structure (200); thereby increasing the magnetic attraction between the primary magnetic anchor (300) and the work structure (200). Conversely, the rotational actuator (374) can rotate the attachment magnet (310) into a disengaged position where both poles of the attachment magnet (310) are parallel to and spaced away from the side of the work structure (200); thereby greatly diminishing the magnetic attraction between the primary magnetic anchor (300) and the work structure (200) allowing the primary magnetic anchor (300) to be removed and transported.

Another embodiment of an anchor release system (350) has an electromagnetic adjustor (380), as seen in FIG. 4. In this embodiment, the primary magnetic anchor (300) may include the previously mentioned body (320); attachment magnet (310); rigging attachment point (330); anchor release system (350); and may include a primary anchor location system (340). Additionally, the anchor release system (350) having an electromagnetic adjustor (380) may also include an electromagnet (382) and a ferromagnetic core (384). In this embodiment, the primary magnetic anchor's (300) electromagnetic (382) is oriented in such a way that when power is applied to the electromagnet (382) the electromagnet's (382) magnetic poles are oriented in an opposite direction from the attachment magnet's (310) magnetic poles. In other words, the North Pole of the attachment magnet (310) abuts the North Pole of the electromagnet (382), or vice versa. When the primary magnetic anchor (300) is an engaged state, the electromagnet (382) is in an off state and the magnetic flux originating from the attachment magnet (310) conductively flows through the electromagnet's (382) ferromagnetic core (384) through part of the wall of the work structure (200) and loops around to the opposite pole on the attachment magnet (310) that the magnetic flux originated from. As a consequence, a strong magnetic attraction between the primary magnetic anchor (300) and the work structure (200) is established. Conversely, when the primary magnetic anchor (300) is an disengaged state, power is applied to the electromagnet (382) creating a new magnetic field oriented in an opposite direction from the magnetic field originating out of the attachment magnet (310). Furthermore, the electromagnet (382) saturates the ferromagnetic core (384) with the magnetic flux originating from the electromagnet (382), thereby cancelling and blocking the magnetic flux originating from the attachment magnet (310) from flowing through the ferromagnetic core (384). As a result, the magnetic attraction of the primary magnetic anchor (300) is greatly diminished; thereby, allowing the removal of the primary magnetic anchor (300) from the work structure (200).

Another embodiment of anchor release system (350) includes a pneumatic adjustor which is not illustrated. In one embodiment a pneumatic cylinder is permanently attached to the end of the attachment magnet (310) and the other end is attached to the body (320) of the primary magnetic anchor (300). The pneumatic cylinder is oriented perpendicular to the work structure's (200) surface such that when it is retracted, the pneumatic cylinder pulls the attachment magnet (310) from the surface of the work structure (200); and as a result, the primary magnetic anchor (300) is able to be removed from the work structure (200). Alternatively, the body (320) may have a connection port for receiving a compressed air hose to power the anchor release system (350). An automatic latch system may be incorporated to latch the pneumatic cylinder in the retracted position; thereby, preventing the attachment magnet (310) from reconnecting with the work structure (200). One embodiment of anchor release system (350) having a pneumatic adjustor uses a pneumatic storage vessel to supply pressurized gas to retract the pneumatic cylinder. In another embodiment of anchor release system (350) having a pneumatic adjustor uses a pyrotechnic charge to generate the pressurized gas needed to retract the pneumatic cylinder.

Still further, the anchor release system (350) may be a manual system. For instance, in situations where a worker has access to the primary anchor position (210), a mechanical advantage worker bar may attach to the body (320) and power the anchor release system (350). For instance, the body (320) may include a small hydraulic system powered by the mechanical advantage worker bar to separate the body (320) from the work structure (200). This embodiment would work in a fashion similar to most hydraulic lift-jacks found in residential garages.

Figure 7:
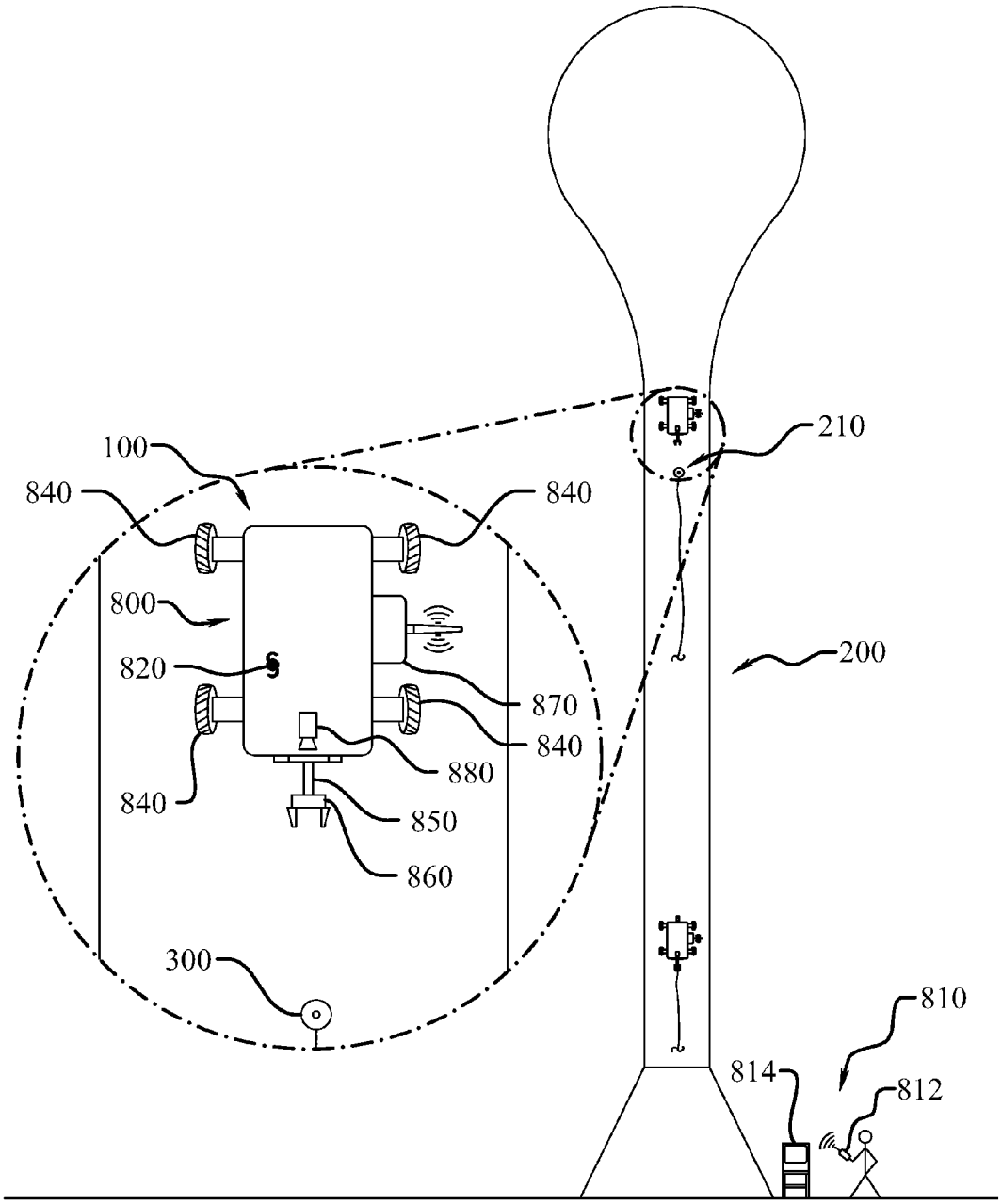
FIG. 7 is a partial side elevation view of a water tank and elements of the invention, not to scale.

With reference now to FIG. 5, a transport vehicle (800) used for transporting and retrieving primary and/or secondary magnetic anchors (300, 1300) is illustrated. The transport vehicle (800) may include a transport vehicle body (820); a coupling system (830); a set of omnidirectional wheels (840); one or more articulated mechanisms (850); one or more gripping mechanisms (860); a communication system (870); and a video system (880). With reference now to FIG. 7, the transport vehicle (800) may have a vehicle control system (810) including in some embodiments a remote terminal (812), and in further embodiments a vision system (814). The vehicle control system (810) will be described in more detail below.

Now referring to FIG. 5, in one embodiment the transport vehicle body (820) has two main functions. One function the transport vehicle body (820) performs is that it acts as a frame onto which the other components are attached. Another function of the transport vehicle body (820) is to serve as a weather-proof housing for the transport vehicle's (800) batteries, electronics and other mechanical mechanisms.

Still referring to FIG. 5, the transport vehicle (800) has a coupling system (830) that allows the transport vehicle (800) to cling to the side of a work structure (200). In one embodiment, the transport vehicle (800) uses rare earth magnetics as the coupling system (830) that creates an attractive force between the transport vehicle (800) and the work structure (200). In another embodiment, the coupling system (830) is vacuum system that creates a vacuum between the transport vehicle (800) and the work structure (200) thereby allowing the transport vehicle (800) to cling to the side of the work structure (200). In yet another embodiment, the coupling system (830) is synthetic setae located on the wheels or other structure of the transport vehicle (800). Synthetic setae adhesive is a dry removable adhesive that was patterned after the setae found on the toes of geckos. Furthermore, setae create an adhesive bond by van der Waals forces acting on the surface they are touching. Additionally, synthetic setae based adhesive allows the peel off removal from surfaces and is self-cleaning unlike other adhesives.

Figure 6:
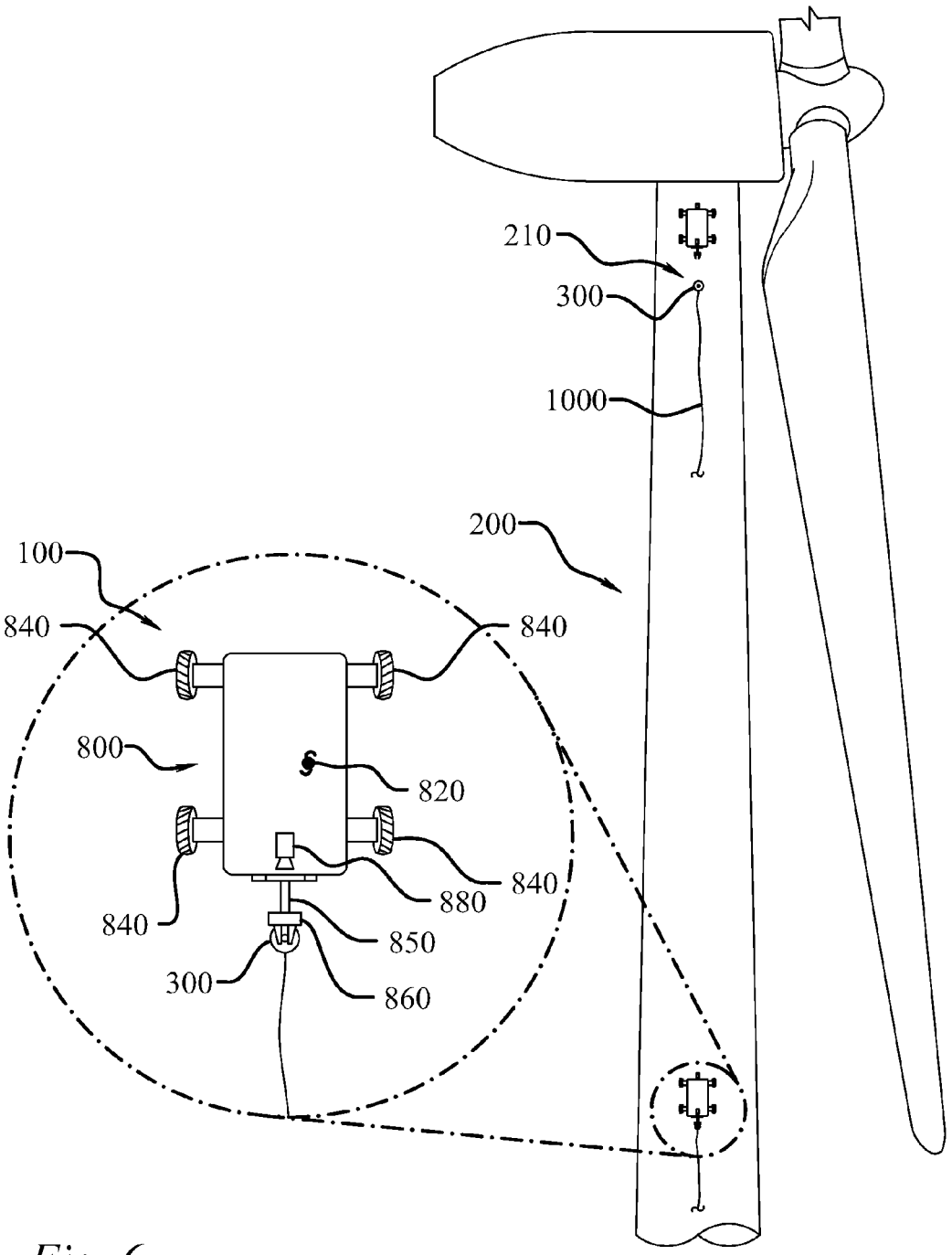
FIG. 6 is a partial side elevation view of a wind turbine tower and elements of the invention, not to scale.

A set of omnidirectional wheels (840) is illustrated in FIGS. 5-7. By using omnidirectional wheels (840) the transport vehicle (800) can move forwards, backwards, side to side, and diagonally. Currently, there are two distinct types of omnidirectional wheels (840) on the commercial market: 1) Omni wheels; and 2) Mecanum wheels.

Omni wheels have, perpendicular to their direction of rotation, small rollers about their circumference. As a result, the wheel freely travels sideways perpendicular to the direction of the wheel roll. In order to make the Omni wheels practical and capable of true omnidirectional travel, the wheels are angled with each other rather than in a parallel fashion. In other words, the right front Omni wheel would be set at a 45 degree angle, the left front Omni wheel would be set at a 135 degree angle, the rear right Omni wheel would be set at a 315 degree angle, and lastly, the left rear Omni wheel would be set at a 225 degree angle. This allows the transport vehicle (800) to move forwards or backwards when all the Omni wheels are turning in the same direction. Sideways movement of the transport vehicle (800) is established by counter rotating the Omni wheels in unique ways. For instance, to cause the transport vehicle (800) to move to the right, the right front Omni wheel and rear left Omni wheel would turn in a clockwise motion, and the left front Omni wheel and rear right Omni wheel would turn in a counterclockwise motion. To make the transport vehicle (800) move sideways to the left, the motion of the Omni wheels are reversed. In addition to forward, back, left and right motion of travel, Omni wheel also allow for diagonal motion. For instance, the transport vehicle (800) can travel at a 45 degree angle by rotating right front Omni wheel and rear left Omni wheel in a clockwise motion, and disengaging the left front Omni wheel and rear right Omni wheel.

Mecanum wheels are very similar to Omni wheels, having small rollers about their circumference. However, unlike Omni wheels were the rollers are perpendicular to the direction of rotation, the rollers on Mecanum wheels are set a 45 or 315 degree angle between parallel and perpendicular to the direction of travel. The configuration of the rollers on the Mecanum wheels allow the Mecanum wheels to be installed parallel to the transport vehicle body (820), unlike Omni wheels that have to be installed at different angles with respect to the transport vehicle body (820). Furthermore, Mecanum wheels operate in the same manner as Omni wheels to achieve forward, back, side to side, and diagonal motion.

With reference now to FIG. 5, an articulated mechanism (850) with one end attached to a transport vehicle (800) and a gripping mechanism (860) attached to other end of the articulated mechanism (850), is illustrated. The articulated mechanism (850) allows for more controlled movements of the gripping mechanism (860) during the primary magnetic anchor (300) placement and retrieval process. In another transport vehicle (800) embodiment, the transport vehicle (800) has two or more articulated mechanisms (850) and two or more gripping mechanisms (860) to transport multiple primary and secondary magnetic anchors (300, 1300) at any given time. The gripping mechanism (860) can have several embodiments. In FIG. 5, the gripping mechanism (860) embodiment has two moveable jaws that clamp down to grip the primary magnetic anchor (300) when a gripping action is desired. Conversely, in order to release a primary magnetic anchor (300), the two moveable jaws are opened.

In another embodiment, the gripping mechanism utilizes an electromagnetic gripper. When it is desirable to grip a primary magnetic anchor (300), the transport vehicle (800) moves in close proximity of the primary magnetic anchor (300), and the articulated mechanism (850) moves the electromagnetic gripping mechanism (860) to touch the side of the primary magnetic anchor (300). After which, the electromagnet located on the gripping mechanism (860) is energized, thereby clamping onto the primary magnetic anchor (300).

In yet another embodiment, the gripping mechanism (860) comprises of a vacuum gripping mechanism (860). When it is desirable to grip a primary magnetic anchor (300), the transport vehicle (800) moves in close proximity of the primary magnetic anchor (300), and the articulated mechanism (850) moves the vacuum gripping mechanism (860) to touch the side of the primary magnetic anchor (300). After which, vacuum is applied to one or more suction cups located on the gripping mechanism (860), thereby clamping the gripping mechanism (860) onto the primary magnetic anchor (300). In order to unclamp from the primary magnetic anchor (300) the vacuum to the suction cups is release.

In a further embodiment the transport vehicle (800) may have a communication system (870) and a video system (880) which interact with a complimentary vehicle control system (810) having a remote terminal (812) and a vision system (814). The transport vehicle (800) communication system (870) may act as both a transmitter and receiver which communicate with at least one remote terminal (812). Furthermore, video data from the transport vehicle (800) video system (880) is sent to the communication system (870) along with other sensor status data gathered by sensors on the transport vehicle (800) and transmitted to the vehicle control system (810) remote terminal (812) and vision system (814). Furthermore, the previous mentioned video data and sensor status data may be compressed and error encoded in the communications system (870) before it is transmitted to the vehicle control system (810). The use of error encoding is a safety feature that allows detection, correction of data being sent between the transport vehicle (800) and the vehicle control system (810). In addition to data error detection and correction, error encoding can also send a retransmission request if the data corruption beyond correction. The data transmitted between the vehicle control system (810) and transport vehicle (800) communications system (870) may utilize an optical laser data transmission system, or a wireless radio data transmission system. Furthermore, the data being sent may use, but is not limited to, Wi-Max, Wi-fi, 2G, 3G, 4G, EV-DO, or Zigbee-type based transmission protocol and hardware.

The combination of the video system (880) and vision system (814), which acts as a visual monitor, allows a maintenance person to remotely view the area surrounding the transport vehicle (800), which would be impossible otherwise. When operating the transport vehicle (800), maintenance personnel control the direction of transport vehicle (800) travel, articulated mechanism (850), and gripping mechanism (860) through the use of the remote terminal (812). In order to prevent unauthorized use of the remote terminal (812), the remote terminal (812) may have a safety control system including, but not limited to, a key lock out system, a pass code lock out system, a magnetic strip swipe card lock out system, a bar code scanner lock out system, a Radio Frequency Identification (RFID) lock out system, a fingerprint or palm print based lock out system, an iris recognition lock out system, and or a retina scan lock out system. Additionally, these variations, modifications, alternatives, and alterations of the various preferred embodiments may be used alone or in combination with one another.

Figure 8:
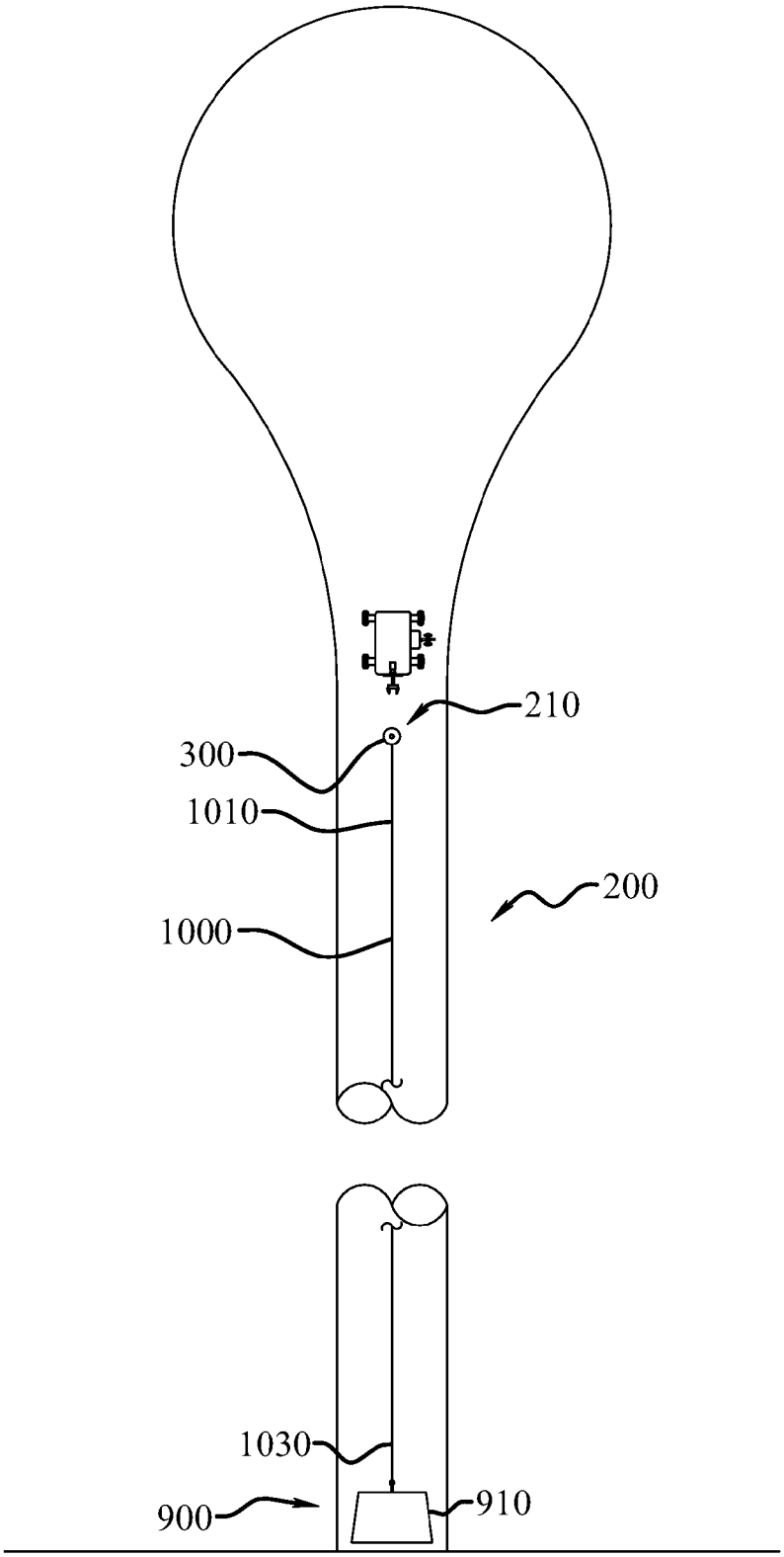
FIG. 8 is a partial side elevation view of a water tank and elements of the invention, not to scale.

The rigging line (1000), as seen in FIGS. 1 and 8, has a rigging line proximal end (1010) which is located closest to the primary magnetic anchor (300), and a rigging line distal end (1030) which is located on the end of the rigging line (1000) farthest away from the primary magnetic anchor (300). The rigging line proximal end (1010) may include a rigging line proximal end connector (1020), as seen in FIGS. 2-4. The rigging line proximal end connector (1020) allows for easy attachment of the rigging line (1000) to the rigging attachment point (330) and may take the form, but not limited to: a carabineer quick link, a cable shackle, or a pulley assembly.

As seen in FIG. 1, the magnetic rigging line anchoring system (100) may also utilizes a life line (1100) to ensure the safety of maintenance personnel in the event of an accidental fall from a work platform (1200). The life line (1100) has a life line proximal end (1110) located closest to the secondary magnetic anchor (1300), and a life line distal end (1120) which is located on the end of the life line (1100) farthest away from the secondary magnetic anchor (1300). Like the rigging line (1000), the life line (1100) may have a life line proximal end (1110) connector that allows for easy attachment of the life line (1100) to the rigging attachment point (300) on a secondary magnetic anchor (1300). The life line distal end (1120) is attached to a life line (1100) safety harness worn by a maintenance worker while on a work platform (1200), that helps protect the maintenance worker from injury or death from an accidental fall. An independent fall arrest system may be connected to the life line (1100) and acts as another safety mechanism for preventing the worker from falling and for providing a means for the rescuer to quickly lower the worker to safety. The independent fall arrest system has a governed decent mechanism that limits the decent rate of falling maintenance personnel in order to prevent injury or death.

Figure 9:
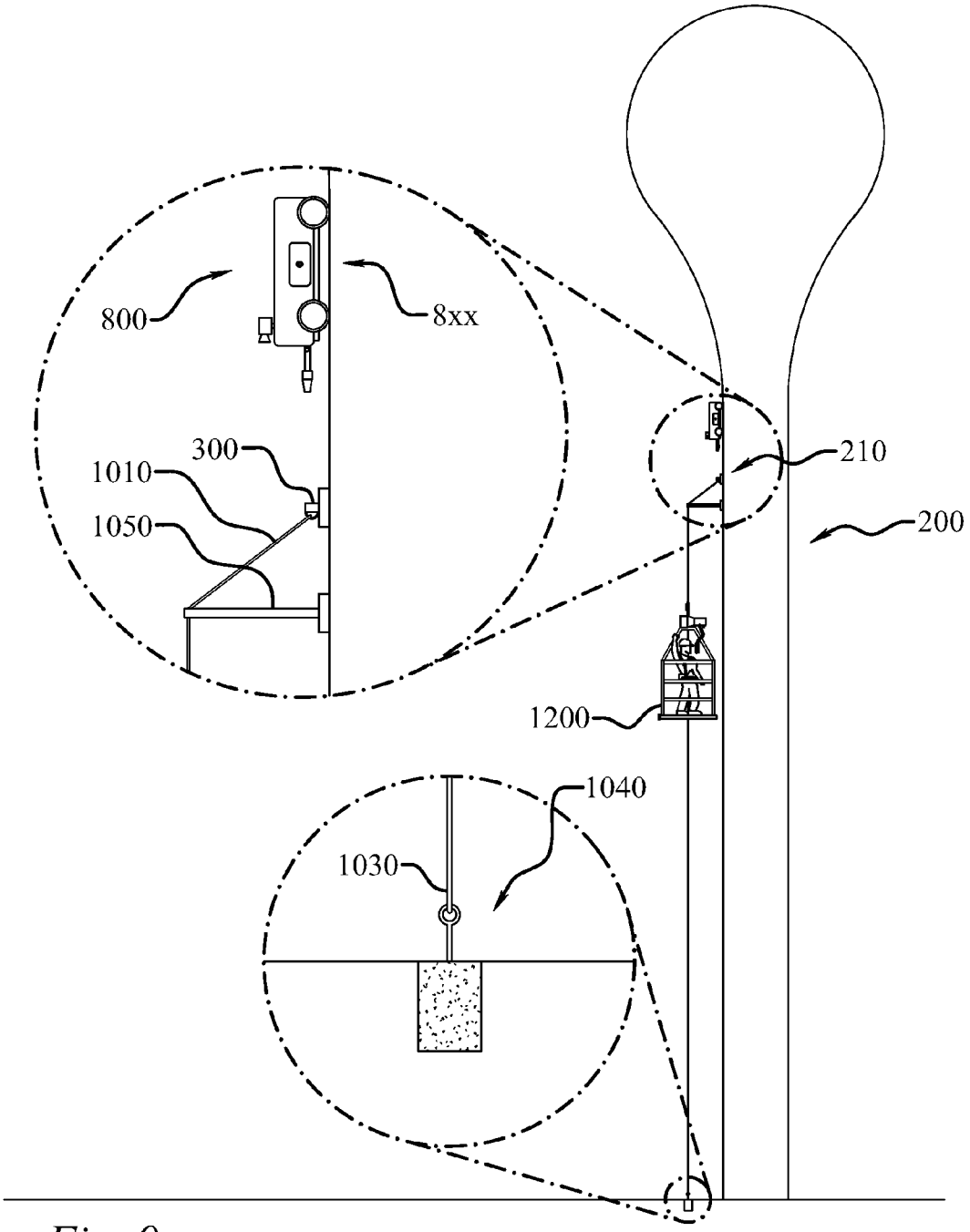
FIG. 9 is a partial side elevation view of a water tank and elements of the invention, not to scale.

With reference to FIG. 9, another embodiment includes a rigging line ferromagnetic work structure spacer (1050) is illustrated. A rigging line ferromagnetic work structure spacer (1050) provides the magnetic rigging line anchoring system (100) two important functions of reducing shear forces acting on the primary and secondary magnetic anchors (300, 1300), and moving the rigging line (1000) away from the work structure (200) to allow for work platform (1200) clearance. The same means of attachment and anchor release systems (350) used in the primary magnetic anchor (300), or any combination thereof, can be used to releasably secure the rigging line ferromagnetic work structure spacer (1050) to the side of the work structure (200).

Now with reference to FIG. 8, a load testing system (900) is illustrated. In order to ensure the safety of maintenance personnel and equipment the level of attachment for both primary and secondary magnetic anchors (300, 1300) has to be performed to ensure that neither the primary and secondary magnetic anchors (300, 1300) will slip or break free. As such, after the primary and secondary magnetic anchors (300, 1300) have been installed, a load is applied to them with a load testing system (900). In one embodiment, illustrated in FIG. 8, the load testing system (900) is a weight applied to the rigging line (1000) or life line (1100) to test how secure the attachments of the primary and secondary magnetic anchors (300, 1300) are. In another embodiment, the load testing system (900) is accomplished by a hydraulic cylinder, pneumatic cylinder, or magnetic load structure that clamps onto the primary and/or secondary magnetic anchor (300, 1300) and applies the appropriate load to ensure no slippage of the primary or secondary magnetic anchors (300, 1300). In yet another variation, a winch system is used to apply the appropriate load to ensure no slippage of the primary or secondary magnetic anchors (300, 1300). An interconnection load system (910) is another safety feature of the load testing system (900), as seen in FIG. 1. The interconnection load system (910) is attached to the primary magnetic anchor (300) and the secondary magnet anchor (1300), and then a predetermined test load is applied to the primary magnetic anchor (300) and the secondary magnet anchor (1300) with the interconnection load system (910). The interconnection load system (910) utilizes movement sensors to monitor both the primary magnetic anchor (300) and the secondary magnet anchor (1300) to ensure continuous secure attachment while in use. Furthermore, if the interconnection load system (910) senses any movement, a warning will be displayed on the remote terminal (812) and an audible and visual alarm will occur, such as a klaxon sounding and or a flashing strobe light.

The work platform (1200), as seen in FIGS. 1 and 9, may include a hoist (1210); safety barrier (1220) and work platform base (1230). Furthermore, the rigging line (1000) is attached to the hoist (1210) in such a way that the hoist (1210) can move the work platform (1200) up and down the rigging line (1000). The safety barrier (1220), as seen in FIG. 1, is a railing or fence system designed to allow the maintenance personnel enough freedom of movement to work on the work structure (200) and keep them from falling from the work platform (1200) at the same time. The work platform base (1230) gives the maintenance personnel a secure place to stand and a place to store supplies and tools.

The work platform (1200) may be designed with several safety features to help prevent injury or death of maintenance personnel. One safety feature designed into the work platform (1200) is a hoist lock out feature to prevent unauthorized use of the work platform (1200). The hoist lock out feature may utilize singularly, or in combination, and not limited to: a key lock out system, a pass code lock out system, a magnetic strip swipe card lock out system, a bar code scanner lock out system, a Radio Frequency Identification (RFID) lock out system, a fingerprint or palm print based lock out system, an iris recognition lock out system, and or a retina scan lock out system.

Another safety feature built into the work platform (1200) is a monitoring and diagnostic system. The monitoring and diagnostic system can monitor work platform (1200) ascent and decent speeds and warn maintenance personnel of a dangerous ascent and decent condition, and if necessary intervene to stop the dangerous ascent or decent condition. In addition to ascent and descent monitoring, the monitoring and diagnostic system can monitor the health of the hoist (1210) to prevent an overload or overheating condition, and warn maintenance personnel if either occur.

A work platform (1200) lateral sway monitoring is yet another safety feature that the monitoring and diagnostic system performs. Suspended work platforms are subjected to strong wind currents that can cause dangerous work conditions for maintenance personnel. The lateral sway monitoring feature of the monitoring and diagnostic system would not only keep track of the actual sway and notify maintenance personnel of an exceed of established lateral sway parameters, but also keep track of escalating lateral sway movement in order to inform maintenance personnel that a rigging line distal end anchor (1040), as seen in FIG. 9, should be used.

Rigging line (1000) sensing is yet another safety feature that the monitoring and diagnostic system may perform. The monitoring and diagnostic system may monitor the rigging line (1000) diameter and/or integrity intermittently or continuously. In one embodiment the monitoring and diagnostic system creates a rigging line (1000) alert when the monitoring and diagnostic system identifies an area of the rigging line (1000) having an undesirable rigging line (1000) attribute such as a rigging line (1000) size less than a predetermined threshold rigging line (1000) size, or a rigging line (1000) abnormality greater than a predetermined rigging line (1000) abnormality tolerance such as a kink, bend, gouge, crushed section, unusual change in profile, or frayed strands. The monitoring and diagnostic system may utilize a non-contact sensing system or a contact sensing system located to sense the portion of the rigging line (1000) that is under a load. Non-contact sensing systems may incorporate measurement systems including, but not limited to, laser, video, IR, LED, phototransistor, and ultrasonic sensors. Multiple predetermined threshold or abnormality values may be incorporated to provide various levels of rigging line (1000) alerts, and thus feedback to an operator regarding the condition of the rigging line (1000), or to prevent further operation of the work platform (1200). For example, a work platform (1200) rigging line (1000) may have an initial diameter that is 8.0 mm, and the predetermined threshold rigging line (1000) size may be 7.4 mm. Therefore, in this example the rigging line (1000) sensing system creates a rigging line (1000) alert when the rigging line (1000) sensing system senses that the rigging line (1000) diameter has become 7.4 mm or less, and may prevent the work platform (1200) from operating.

The method of using a magnetic rigging line anchoring system (100) in order to remotely attach a suspended work platform (1200) to a work structure (200) includes the step of positioning a primary magnetic anchor (300) in a transport vehicle (800) and attaching the transport vehicle (800) to the work structure (200). In some instances, the transport vehicle (800) is light enough in weight that maintenance personnel can simply lift and place the transport vehicle (800) on the side of the work structure (200). In some applications, however, the transport vehicle (800) weighs too much to be lifted by maintenance personnel and must be lifted and positioned on the work structure (200) by a fork lift, or other equipment designed to lift the load. After the transport vehicle (800) is attached to the side of the work structure (200), the transport vehicle (800) transports the primary magnetic anchor (300) vertically to a primary anchor position (210) on the work structure (200) at a primary anchor position elevation, as seen in FIG. 1. After the transport vehicle (800) reaches the primary anchor position (210), the primary magnetic anchor (300) is attached to the work structure (200) at the primary anchor position (210). Next, after the primary magnetic anchor (300) is attached to the work structure (200), the strength of the connection of the primary magnetic anchor (300) to the work structure (200) is tested to ensure that no slippage or primary magnetic anchor (300) disengagement will occur. A load testing system (900) comprising of a standardized load may be used to ensure a satisfactory attachment of the primary magnetic anchor (300) to the work structure (200). Alternatively, in other embodiments, the load testing system (900) may utilize singularly or in combination: a winch system, a hydraulic cylinder, a pneumatic cylinder, or a magnetic load structure to deliver a predetermined load to ensure a satisfactory attachment of the primary magnetic anchor (300) to the work structure (200). After verifying the connection quality of the primary magnetic anchor (300) to the work structure (200), maintenance personnel attach and suspend the work platform (1200) and a hoist (1210) on a rigging line (1000) secured to the primary magnetic anchor (300).

Next, the transport vehicle (800) may be transported vertically to the ground level, after which steps may be taken to position a secondary magnetic anchor (1300) in the transport vehicle (800). Next, the transport vehicle (800) transports the secondary magnetic anchor (1300) vertically with the transport vehicle (800) to a secondary anchor position (220) on the work structure (200) at a secondary anchor position elevation. After reaching the secondary anchor position (220), the secondary magnetic anchor (1300) is attached to the work structure (200) at the secondary anchor position (220). Next, after the secondary magnetic anchor (1300) is attached to the work structure (200), the strength of the connection of the secondary magnetic anchor (1300) to the work structure (200) is tested to ensure that no slippage or disengagement will occur. A load testing system (900) comprising of a standardized load may be used to ensure a satisfactory attachment of the secondary magnetic anchor (1300) to the work structure (200). Alternatively, in other embodiments, the load testing system (900) may utilize singularly or in combination: a winch system, a hydraulic cylinder, a pneumatic cylinder, or a magnetic load structure to deliver a predetermined load to ensure a satisfactory attachment of the primary magnetic anchor (300) to the work structure (200). After verifying the connection quality of the secondary magnetic anchor (1300) to the work structure (200), a life line (1100) is suspended from the secondary magnetic anchor (1300).

Alternatively, it is possible to position both the primary and secondary magnetic anchor (300, 1300) at the same time in the transport vehicle (800) having more than one articulated mechanism (850) and gripping mechanism (860). After the primary and secondary magnetic anchors (300, 1300) are successfully positioned in the transport vehicle (800), the transport vehicle (800) is attached to the work structure (200). After the transport vehicle (800) is attached to the side of the work structure (200), the transport vehicle (800) transports the primary and secondary magnetic anchor (300, 1300) vertically to a primary anchor position (210) on the work structure (200) at a primary anchor position elevation, as seen in FIG. 1. After the transport vehicle (800) reaches the primary anchor position (210), the primary magnetic anchor (300) is attached to the work structure (200) at the primary anchor position (210). Following the attachment of the primary magnetic anchor (300), the transport vehicle (800) transports the secondary magnetic anchor (1300) to the secondary anchor position (220) on the work structure (200), and afterwards, the secondary magnetic anchor (1300) is attached to the work structure (200) at the secondary anchor position (220). Next, after the primary and secondary magnetic anchors (300, 1300) have been attached to the work structure (200), the strength of the connection of the primary and secondary magnetic anchors (300, 1300) to the work structure (200) are tested to ensure that no slippage or primary or secondary magnetic anchor (300, 1300) disengagement will occur. A load testing system (900) comprising of a standardized weight may be used to ensure a satisfactory attachment of the primary and secondary magnetic anchors (300, 1300) to the work structure (200). Alternatively, in other embodiments, the load testing system (900) may utilize singularly or in combination: a winch system, a hydraulic cylinder, a pneumatic cylinder, or a magnetic load structure to deliver a predetermined load to ensure a satisfactory attachment of the primary and secondary magnetic anchors (300, 1300) to the work structure (200). After verifying the connection quality of the primary and secondary magnetic anchors (300, 1300) to the work structure (200), maintenance personnel attach and suspend a work platform (1200) and a hoist (1210) on a rigging line (1000) secured to the primary magnetic anchor (300). In this embodiment, time is saved by skipping the steps of returning the transport vehicle (800) to ground level to position the secondary magnetic anchor (1300) in the transport vehicle (800) and transporting the secondary magnetic anchor (1300) to the secondary anchor position (220).

It should also be noted that instead of using a standardized weight or winch system to ensure a satisfactory attachment of the primary and secondary magnetic anchors (300, 1300) to the work structure (200), an interconnection load system (910) can be used. In this embodiment, after the primary and secondary magnetic anchors (300, 1300) have been attached to the work structure (200), the primary and secondary magnetic anchors (300, 1300) are joined by an interconnection load system (910). Next, the attachment strength of the primary and secondary magnetic anchors (300, 1300) are tested by applying a predetermined test load to the primary and secondary magnetic anchors (300, 1300) with the interconnection load system (910). During the primary and secondary magnetic anchor (300, 1300) attachment strength test, sensors may be used to detect movement of at least one of the primary magnetic anchor (300) and/or the secondary magnetic anchor (300). The status of acceptable attachment strength or failure of the load system test can be indicated by status lights on the primary and secondary attachment magnetic anchors (300, 1300), or alternatively, by transmitting a load system test signal indicating acceptable attachment strength or failure from the interconnection load system (910).

During the act of transporting the primary magnetic anchor (300) and secondary magnetic anchors (1300) and other required movements, the transport vehicle (800) is controlled with a vehicle control system (810). The vehicle control system (810) may have a remote terminal (812), used in combination with the transport vehicle's (800) video system (880), that allows maintenance personnel to steer the transport vehicle (800) vertically to the primary anchor position (210). Before attaching the primary or secondary magnetic anchors (300, 1300), maintenance personnel may visually inspect the primary anchor position (210) with the vision system (814) prior to attaching the primary or secondary magnetic anchors (300, 1300) to the work structure (200) at the primary or secondary anchor positions (210, 220). In one embodiment, during the process of attaching the primary or secondary magnetic anchors (300, 1300), the initiation of the attachment is accomplished from the remote terminal (812). In another embodiment, the initiation of the attachment is accomplished through automated transport vehicle (800) control software once the transport vehicle reaches the appropriate primary or secondary anchor positions (210, 220).

After the maintenance on the work structure (200) is complete the primary and secondary magnetic anchors (300, 1300) need to be disengaged so that they can be transported to ground level by the transport vehicle (800). In order to disengaged the primary and secondary magnetic anchors (300, 1300), the magnetic force exerted must be reduced or overcome, and is accomplished by activating an anchor release system (350). In one embodiment, the activation of the anchor release system (350) is only enabled if the transport vehicle (800) is in physical contact with the primary or secondary magnetic anchor (300, 1300) to be released. In another embodiment, the activation of the anchor release system (350) is accomplished by a command sent from the remote terminal (812). Furthermore, a system of catch nets may be used to arrest the fall of the disengaged primary and secondary magnetic anchors (300, 1300) released from the work structure (200).

Thus far in the disclosure one aspect of the magnetic rigging line anchoring system (100) has focused on the use of a transport vehicle (800) to transport and attach/retrieve a primary magnetic anchor (300). However, there are instances where maintenance personnel can easily access the primary anchor position (210) and/or secondary anchor position (220) and desire to attach a primary magnetic anchor (300) by hand without using a transport vehicle (800). For instance there are many situations in which maintenance personnel working on a structure, whether it be a bridge, a tank, a marine vessel, etc., can simply carry a primary magnetic anchor (300) to a primary anchor position (210) an attach it.

In one particular embodiment has found a preferred balance among the total weight of the primary magnetic anchor (300), including all its components, and the load carrying capacity of the primary magnetic anchor (300). Thus, in this embodiment the primary magnetic anchor weight is less than 5% of the tensile load capacity of the primary magnetic anchor (300) and is less than 10% of the shear load capacity. In one particular embodiment the shear load capacity is at least 1000 lbf, while a preferred embodiment has a shear load capacity of at least 2000 lbf. Such embodiments may incorporate in excess of ten individual attachment magnets (310). In fact one embodiment incorporates twenty 3" diameter and 1" thick neodymium disc magnets, each one having a tensile load capacity of at least 375 lbf and a shear load capacity of at least 100 lbf. The total weight of the primary attachment anchor (300) is preferably less than 100 pounds and it preferably has a maximum dimension of 18 inches to ensure easy maneuverability and ingress/egress from confined spaces.

After maintenance personnel attaches the primary magnetic anchor (300) to the work structure (200), the strength of the connection of the primary magnetic anchor (300) to the work structure (200) is tested to ensure that no slippage or primary magnetic anchor (300) disengagement will occur. A load testing system (900) comprising of a standardized load may be used to ensure a satisfactory attachment of the primary magnetic anchor (300) to the work structure (200). Alternatively, in other embodiments, the load testing system (900) may utilize singularly or in combination: a winch system, a hydraulic cylinder, a pneumatic cylinder, or a magnetic load structure to deliver a predetermined load to ensure a satisfactory attachment of the primary magnetic anchor (300) to the work structure (200). After verifying the connection quality of the primary magnetic anchor (300) to the work structure (200), maintenance personnel attach and suspend the work platform (1200) and a hoist (1210) on a rigging line (1000) secured to the primary magnetic anchor (300), wherein the hoist (1210) raises and lowers the work platform (1200) on the rigging line (1000). Additionally, a second primary magnetic anchor (300) can be attached on the opposite side of the work structure (200), adjacent the primary anchor position (210) to cooperate with the primary magnetic anchor (300), thereby increasing the load carrying capacity;

for example, the primary magnetic anchor (300) may be positioned on the exterior surface of a structure, and the secondary magnetic anchor (1300) may be positioned on the opposite surface so that the structure is sandwiched between the primary magnetic anchor (300) and the secondary magnetic anchor (1300).

The primary magnetic anchor (300) has an anchor release system (350) that is designed in such a way that a disengagement force, which is less than the primary magnetic anchor (300) weight, applied to the anchor release system (350) will release the primary magnetic anchor (300) from the work structure (200). As an added safety measure, in some embodiments the primary magnetic anchor (300) may have a release safety and the anchor release system (350) that is only capable of activation when the release safety has been disengaged. After the maintenance is completed on the work structure (200), maintenance personnel apply a disengagement force to the anchor release system (350) and remove the primary magnetic anchor (300) from the work structure (200).

In this embodiment, the anchor release system (350) may utilize the previously disclosed: set-off distance adjustor (360) to change the distance of an attachment magnet (310) from the work structure (200), such as a drive screw (362) and a drive screw actuator (364) system; the rotational adjustor (370) to change the orientation of an attachment magnet (310), such as a rotational shaft (372) and a rotational actuator (374) system; or the electromagnetic adjustor (380) system to temporarily change the magnet flux of an attachment magnet (310) and therefore the magnetic force.

Numerous alterations, modifications, and variations of the preferred embodiments disclosed herein will be apparent to those skilled in the art and they are all anticipated and contemplated to be within the spirit and scope of the magnetic rigging line anchoring system (100). For example, although specific embodiments have been described in detail, those with skill in the art will understand that the preceding embodiments and variations can be modified to incorporate various types of substitute and or additional or alternative materials, relative arrangement of elements, and dimensional configurations. Accordingly, even though only few variations of the magnetic rigging line anchoring system (100) are described herein, it is to be understood that the practice of such additional modifications and variations and the equivalents thereof, are within the spirit and scope of the invention. Further, references to suspension equipment and suspended work platform are used herein; however one skilled in the art will appreciate that the present invention may be used in other applications not having suspended equipment or platforms. In fact in one such embodiment the transport vehicle (800) does not transport a magnetic anchor but rather is used to transport a rigging line (1000) to a permanent attachment point on the work structure (200) and attached the rigging line (1000) to the attachment point.

We claim:

1. A method of remotely attaching a suspended work platform (1200) to a work structure (200), comprising:

a) positioning a primary magnetic anchor (300) in a transport vehicle (800);

b) attaching the transport vehicle (800) to the work structure (200);

c) transporting the primary magnetic anchor (300) vertically with the transport vehicle (800) along a surface of the work structure to a primary anchor position (210) on the work structure (200) at a primary anchor position elevation;

d) attaching the primary magnetic anchor (300) to the work structure (200) at the primary anchor position (210);

e) testing the strength of the connection of the primary magnetic anchor (300) to the work structure (200);

f) suspending the work platform (1200) and a hoist (1210) on a rigging line (1000) secured to the primary magnetic anchor (300); and wherein the step of transporting the primary magnetic anchor (300) vertically with the transport vehicle (800) is controlled with a vehicle control system (810) and includes the step of steering the transport vehicle (800) from a remote terminal (812).

2. The method of claim 1, further including the steps of:

a) positioning a secondary magnetic anchor (1300) in the transport vehicle (800);

b) transporting the secondary magnetic anchor (1300) vertically with the transport vehicle (800) to a secondary anchor position (220) on the work structure (200) at a secondary anchor position elevation;

c) attaching the secondary magnetic anchor (1300) to the work structure (200) at the secondary anchor position (220);

d) testing the strength of the connection of the secondary magnetic anchor (1300) to the work structure (200); and e) suspending a life line (1100) from the secondary magnetic anchor (1300).

3. The method of claim 2, wherein both the primary magnetic anchor (300) and the secondary magnetic anchor (1300) are positioned in the transport vehicle (800) at the same time.

4. The method of claim 2, wherein the primary magnetic anchor (300) and the secondary magnetic anchor (1300) are joined by an interconnection load system (910), and the steps of testing the strength of the primary magnetic anchor (300) and the secondary magnetic anchor (1300) includes the step of applying a predetermined test load to the primary magnetic anchor (300) and the secondary magnet anchor (1300) with the interconnection load system (910), and the step of sensing movement of at least one of the primary magnetic anchor (300) and the secondary magnetic anchor (300).

5. The method of claim 4, further including the step of transmitting a load system test signal from the interconnection load system (910).

6. The method of claim 1, wherein the step of attaching the primary magnetic anchor (300) to the work structure (200) at the primary anchor position (210) includes the step of initiating the attachment from the remote terminal (812).

7. The method of claim 1, wherein the primary magnetic anchor (300) includes a primary anchor location system (340) in communication with the vehicle control system (810), wherein the primary anchor location system (340) guides the transport vehicle (800) to the primary anchor position (210).

8. The method of claim 1, further including the step of visually inspecting the primary anchor position (210) with a vision system (814) prior to attaching the primary magnetic anchor (300) to the work structure (200) at the primary anchor position (210), wherein the vehicle control system (810) includes a remote terminal (812), and images from the vision system (814) are automatically transmitted to the remote terminal (812).

9. The method of claim 1, further including the steps of:

a) removing the primary magnet anchor (300) from the work structure (200);

b) transporting the primary magnetic anchor (300) vertically with the transport vehicle (800); and c) wherein the step of removing the primary magnet anchor (300) from the work structure (200) includes the activation of an anchor release system (350) to reduce the magnetic force exerted by the primary magnet anchor (300) so the primary magnetic anchor (300) can be transported by the transport vehicle (800).

10. The method of claim 9, wherein the anchor release system (350) is only capable of activation when the transport vehicle (800) is in contact with the primary magnetic anchor (300).

11. The method of claim 9, wherein the anchor release system (350) includes a rotational adjustor (370 to change the orientation of an attachment magnet (310) and therefore the magnetic force.

12. The method of claim 1, wherein the primary magnetic anchor (300) includes a friction inducing surface in contact with the work structure (200).

13. The method of claim 12, wherein the primary magnetic anchor (300) includes a body (320) formed of non-ferrous material housing a plurality of neodymium magnets.

* * * * *